US006678987B2

(12) United States Patent
Howe

(10) Patent No.: US 6,678,987 B2
(45) Date of Patent: Jan. 20, 2004

(54) GUN SIGHT SYSTEM

(75) Inventor: Phillip D. Howe, Fort Collins, CO (US)

(73) Assignee: North Pass, Ltd., Fort Collins, CO (US)

( * ) Notice: Subject to any disclaimer, the term of this patent is extended or adjusted under 35 U.S.C. 154(b) by 16 days.

(21) Appl. No.: 10/038,128

(22) Filed: Jan. 2, 2002

(65) Prior Publication Data

US 2003/0121196 A1 Jul. 3, 2003

(51) Int. Cl.[7] ..... F41G 1/32
(52) U.S. Cl. ..... 42/132; 42/133
(58) Field of Search ..... 42/132, 133

(56) References Cited

U.S. PATENT DOCUMENTS

| | | | | |
|---|---|---|---|---|
| 898,531 | A | | 9/1908 | Tufts |
| 2,970,380 | A | | 2/1961 | Hill |
| 3,678,590 | A | | 7/1972 | Hayward |
| 3,698,092 | A | | 10/1972 | Rosenhan |
| 3,886,667 | A | | 6/1975 | Rueb |
| 4,745,686 | A | | 5/1988 | Willis |
| 4,745,698 | A | * | 5/1988 | Schwulst |
| 5,279,061 | A | * | 1/1994 | Betz et al. |
| 5,560,113 | A | * | 10/1996 | Simo et al. |
| 5,638,604 | A | | 6/1997 | Lorocco |
| 5,735,070 | A | * | 4/1998 | Vasquez et al. |
| 5,822,872 | A | | 10/1998 | Waki |
| 5,862,618 | A | | 1/1999 | Brown |
| 5,878,503 | A | * | 3/1999 | Howe et al. |
| 5,926,963 | A | * | 7/1999 | Knight |
| 5,956,854 | A | * | 9/1999 | Lorocco |
| 6,014,830 | A | | 1/2000 | Brown et al. |
| 6,035,539 | A | | 3/2000 | Hollenbach et al. |
| 6,058,615 | A | * | 5/2000 | Uhlmann et al. |
| 6,122,833 | A | * | 9/2000 | Lorocco |
| 6,360,471 | B1 | | 3/2002 | Stein |
| 6,360,472 | B1 | * | 3/2002 | Lorocco |
| 6,446,377 | B1 | | 9/2002 | Hollenbach et al. |

* cited by examiner

*Primary Examiner*—Michael J. Carone
*Assistant Examiner*—Troy Chambers
(74) *Attorney, Agent, or Firm*—Rob L. Phillips; Quirk & Tratos

(57) ABSTRACT

A gun sight system includes a front sight and a rear sight providing high shot accuracy and immediate target acquisition. Each sight having light-gathering means functions dependently defining a highly visible aiming point. An elongated light-gathering plastic rod retained on a front sight base member includes a triangular viewing surface. An oval-shaped light-gathering plastic rod, retained within a rear sight housing, includes two triangular shaped viewing surfaces disposed in a V-shaped void of the housing. From a user's perspective three lighted triangular shaped viewing ends of the light-gathering means define an aiming point and provide immediate target acquisition.

17 Claims, 3 Drawing Sheets

GUN SIGHT SYSTEM

FIELD OF THE INVENTION

The present invention relates to a gunsight system for a firearm allowing faster target acquisition and providing a more precise aiming point. More particularly, the system utilizes a plurality of light gathering means to accurately define an aiming point while providing immediate target acquisition.

BACKGROUND OF THE INVENTION

During the years, firearm sights have been improved consistently to provide a user more accuracy under nearly all conditions. The use of reflective materials, light-gathering flourescent fibers and fiber optics have been utilized to design highly visible gun sights under all conditions, including low-light.

U.S. Pat. No. 5,878,503 (the '503 Patent) to Howe et al., and assigned to the assignee of the present application, discloses a high visibility gun sight system for detachable mounting on a gun barrel. The system uses a light-gathering plastic rod to provide a highly visible gun sight in low light conditions. As taught by the '503 Patent, the gun sight system, including the plastic rod, is mounted on an upper surface of a gun barrel in line with a raised bead sight normally manufactured near a distal end of the gun barrel. The plastic rod thereby instantly attracts a user's focus under circumstances that the raised bead will not.

U.S. Pat. No. 5,638,604 (the '604 Patent) to Lorocco discloses various configurations of sighting devices for projectile type weapons. Each design configuration employs light-gathering flourescent fiber to gather and amplify natural light. In one embodiment illustrated in FIG. 14 of the '604 Patent, three individual light-gathering fibers form a sight plane for aiming within a scope housing. Set screws permit said light-gathering fibers to be adjusted within the scope housing.

While the '503 and '604 Patents disclose useful gun sights, the need exists to implement a gun sight system, for all firearms most notably a shotgun with a ventilated ribbed barrel, able to accurately define an aiming point while allowing immediate target acquisition. The present invention utilizes a front and rear sight each including light-gathering means to define a precise aiming point providing immediate target acquisition. Triangular ends of said light-gathering means viewable by a user clearly define an aiming point.

SUMMARY OF THE INVENTION

The system of the present invention includes a rear and front sight each having colored light-gathering means as known in the art. Said front sight comprises a base member, retaining an elongated light-gathering rod, mounted to a gun barrel spaced from a muzzle end of said gun barrel. One end of said light-gathering rod viewable by a user is in the shape of a triangle directed upward.

The rear sight comprises a housing, with a retaining member for retaining an oval-shaped light-gathering rod with two ends, mounted to the gun barrel spaced rearward of said front sight. Said ends of the oval-shaped pipe define an aiming plane within a void bounded by said housing. Each end of the oval-shaped pipe viewable by the user is formed in the shape of a triangle in planar alignment with one another.

The front and rear sights are aligned such that the three pipe triangles define a precise aiming point for the user. From the user's perspective, an upper point of the front triangle aligned flush with an imaginary line joining the rear triangles results in an accurate shot. However, both the front and rear sights include adjustable means to implement the most accurate configuration and alignment of triangles considering all circumstances.

BRIEF DESCRIPTION OF THE DRAWINGS

These and other features and advantages, will become better appreciated as the same becomes better understood with reference to the claims, specification and drawings wherein:

DETAILED DESCRIPTION

Figures 1, 5, 6:
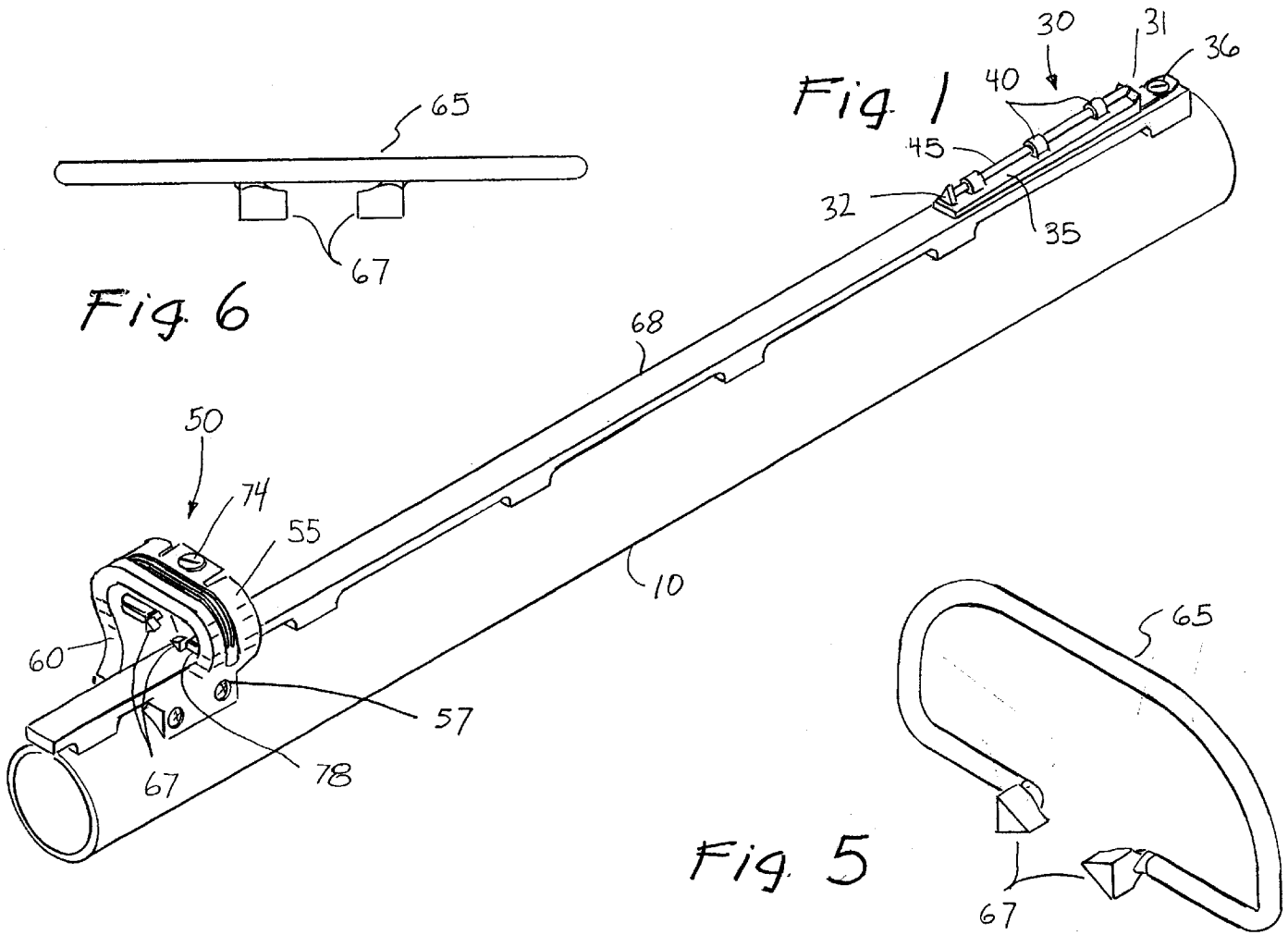
FIG. 1 is a perspective view of the present invention mounted on a ventilated ribbed gun barrel.
FIG. 5 is a perspective view of the rear gun sight light-gathering means.
FIG. 6 is a top view of the rear gun sight light-gathering means.
Figure 2:
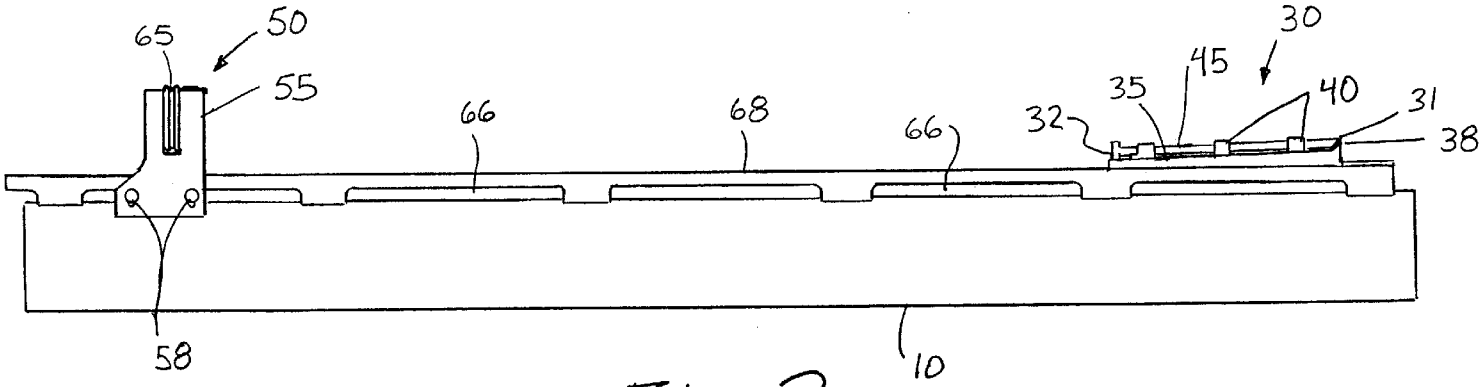
FIG. 2 is a side view of the present invention mounted on a ventilated ribbed gun barrel.
Figure 4:
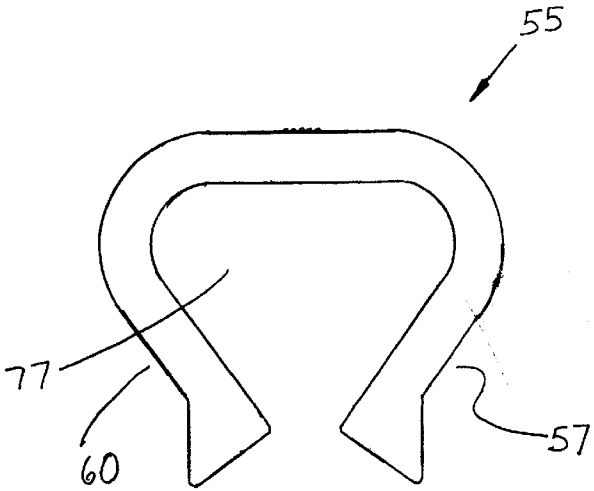
FIG. 4 is a rear view (from a user's perspective) of the rear gun sight housing.
Figure 3:
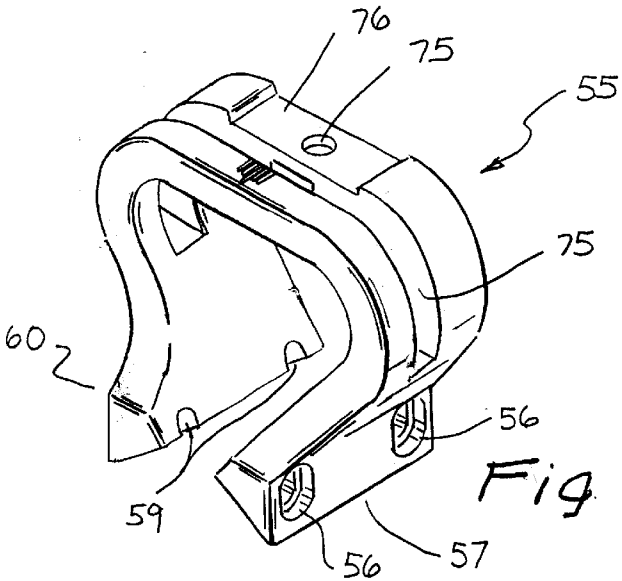
FIG. 3 is a perspective view of the rear gun sight housing of the present invention.
Figure 7:
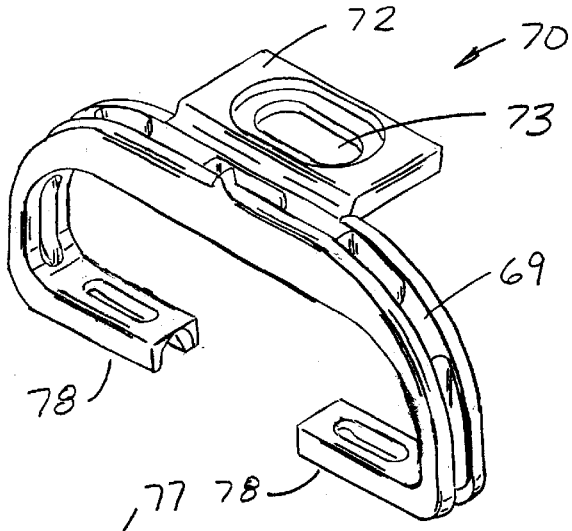
FIG. 7 is a perspective view of the rear sight retainer member of the present invention.

Reference is now made to the figures wherein like parts are referred to by like numerals throughout. FIGS. 1 and 2 show the present invention mounted on a gun barrel 10 including a front sight 30 and a rear sight 50. In a preferred embodiment, the sights 30, 50 are mounted to a ventilated rib 68 extending along a top edge of the barrel 10.

The front sight 30 includes a base member 35 having spaced stirrups 40 extending upwardly from an upper surface thereof. Said stirrups 40 define a longitudinal passage therethrough for detachably securing a first light gathering tube or rod means 45. Three stirrups 40 are spaced apart along the length of the plastic rod and positioned such that they hold and support the plastic rod in a plane parallel to the longitudinal axis of the gun barrel 10 and in proper alignment with the longitudinal axis of the barrel 10.

Said base member 35 is mounted to the top edge of the barrel 10, spaced from a front end thereof, by means of a screw 36 inserted through a base member opening 36, having a countersink to receive a head of the screw 36, and then inserted and tightened by means of screw 36 threads into the rib 68 securing the base member 35. A commercially available compound known as Loctite® my be used in conjunction with the screw 36 or double-sided tape may be applied along the underside of the base member 35 to further secure the base member 35.

Said base member 35 preferably slopes upward 1½° toward a front end of the base member 35. The slight slope is designed to prevent the pressure created by the attachment means at the front end of the base member 35 from forcing the rearward end of the base member 35 above the gun barrel 10. The slightest fluctuation in the position of the base member 35 will reduce the accuracy of the gun sight system.

In a preferred embodiment, the first light-gathering means 45 comprises a length of solid cylindrical colored plastic rod which is light-transparent. Preferably the exterior surface of the plastic rod is very smooth or polished. The forward end 31 of the plastic rod is preferably a sloped planer end. The rearward end or viewing end 32 of the plastic rod is triangular shaped and preferably has a planer surface which is a matte or slightly roughened surface.

The plastic rod can be formed from a variety of well-known plastics such as acrylics, nylon, polycarbonate, polystyrene, etc. in which a soluble colored dye is included. In general terms, any self-supporting light-transparent plastic may be used for this purpose.

Preferably the upper surface of the base member 35 includes a longitudinal recess or groove for guiding the plastic rod when the plastic rod is being slidably inserted beneath the stirrups 40 on the base member 35. A stop member 38 at a forward end of the base member 35 serves to prevent the plastic rod from being pushed too far forwardly on the base member. It also prevents the forward end of the plastic rod from catching or snagging on brush, weeds, twigs, etc.

Since the plastic rod is detachable from the base member 35, it is very easy to install different plastic rods whenever that is necessary or desirable. Different colored plastic rods may be more effective in differing light conditions. Further, different sized triangular viewing ends 32 of the plastic rod provide a means for adjusting the elevation of the front sight 30 to account for vertical firing inaccuracies. Therefore, the interchangeable rods are used to effectively calibrate the firing of the gun in a vertical plane.

Now referring to FIGS. 3, 4, 5, 6 and 7 the rear sight 50 comprises a housing 55, a retainer member 70 and a second light-gathering means 65. Said housing 55, including a first leg 57 and a second leg 60, defines a V-shaped void 77. Said first leg 57 includes two openings 56, spaced from a bottom surface thereof, having countersinks to receive heads of bolts 58 which extend through openings 56 and then through vents 66 of rib 68 and insert through corresponding openings 59 spaced from a bottom surface of the second leg 60 such that a nut may be applied thereto, causing said legs 57, 60 to detachably engage opposite sides of rib 68.

The second light-gathering means 65 is comprised of the same material, with the same properties, as the first light-gathering means 45 described above. However, the second light-gathering means 65 comprises a semi-oval plastic rod with two ends 67 each triangular in shape defining a planar space therebetween. The two triangular-shaped ends 67 project, when installed, in the rearward direction such that the ends 67 are offset from a plane defined by the semi-oval plastic rod. Without departing from the scope of the present invention, the ends 67 can also be implemented within the plane defined by the semi-oval plastic rod. In other words, it is not imperative that the ends "project" in the rearward direction but they need only face in the rearward direction. As with the first light-gathering means 45, viewable surfaces of ends 67 preferably have a planer surface which is a matte or slightly roughened surface.

Upon installation, said semi-oval plastic rod seats in groove 69 that traverses the perimeter of retaining member 70 that inserts into a recess 75 in the housing 55. The retaining member 70 has the overall shape of the semi-oval plastic rod such that, while seated in groove 69, the plastic rod circumscribes the retaining member 70. As required, the recess 75 allows a majority of the oval-shaped plastic rod to be exposed to light.

A rectangular planar surface 72 extending from an upper surface of said retaining member 70, includes an opening 73, having a countersink, for insertion of a screw 74 therethrough and into opening 75 in said housing thereby securing the retaining member 70 and the second light-gathering means 65 to the housing 55. The planar surface 72 is accommodated by a rectangular notch 76 on an upper surface of the housing 55. Said notch 76 has a greater length that the planar surface 72 allowing the retaining member 70 to be shifted laterally for reasons described hereinafter. To facilitate the lateral shift of the retaining member 70, said opening 73 is oval-shaped and larger than a head of screw 74 permitting screw 74 to be properly aligned with opening 75 even though the retaining member 70 may have been shifted laterally.

Figure 8:
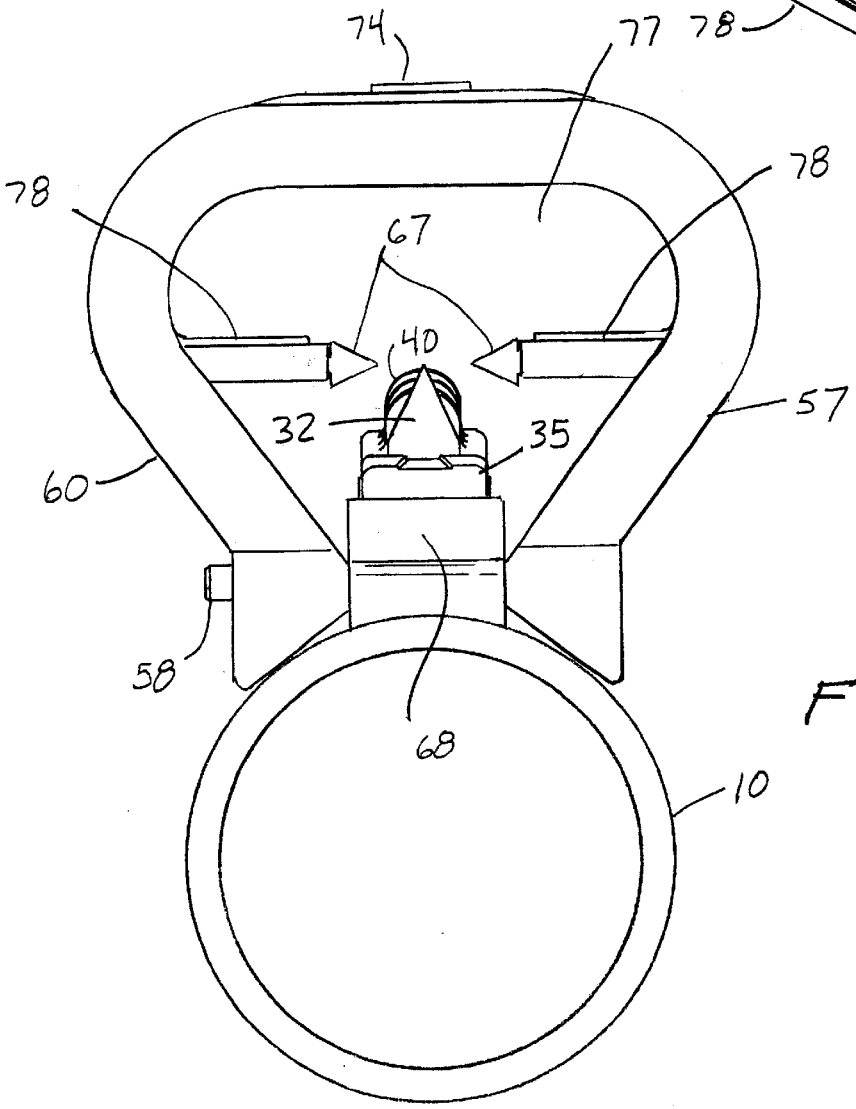
FIG. 8 is a rear view (from a user's perspective) of the present invention mounted on a ventilated ribbed gun barrel.

Now referring to FIG. 8, when mounted together, each end 67 of the oval-shaped plastic rod of the rear sight 50 extends into the V-shaped void 77 from opposite directions to define a planar space therebetween. Except for the triangular ends 67, the housing 55 and arms 78 of the retaining member 70 conceal the oval-shaped plastic rod from a rearward view so as to quickly focus a firearm user's attention to the triangular ends 67.

Besides protecting the oval-shaped plastic rod of the rear sight 50 from breakage, the retaining member 70 also allows for lateral shifting of the oval-shaped plastic rod. Further, lateral shifting of the oval-shaped plastic rod provides a means for accounting for horizontal firing inaccuracies. Therefore, the shifting means is used to effectively calibrate the firing of the gun in a horizontal plane.

From a firearm user's view, the two sights 30, 50 and their respective light-gathering means 45, 65 provide three viewable lighted triangular surfaces defining a precise aiming point. During use, the lighted triangles quickly draw the attention of a firearm user providing quick target acquisition and firing capability.

In a preferred embodiment, the present invention is designed to hunt turkey. The turkey's frame is unique in that the head is remotely located from the turkey's body by an elongated neck. Turkey hunters desire to kill turkeys with head shots and therefore require a gun sight with supreme accuracy. Turkeys rarely remain still further requiring means to quickly acquire precise aim on the turkey's head. The present invention provides the needed accuracy and immediate target acquisition necessary to effectively hunt turkeys. While well-suited for turkey hunting, the gun sight system disclosed herein is effective for hunting all varieties of game.

Although the gun sight system is shown implemented on a ventilated ribbed barrel 10, it is to be understood that the gun sight system of the present invention is equally efficient with all firearms, including those with non-ribbed barrels. Moreover, the base member 35, housing 55 and the retainer member 70 are preferably fabricated of nylon but said components may be fabricated of any plastic, metal, alloy, polymer, etc.

Although the invention has been described in detail with reference to the preferred embodiment, additional variations and modifications exist within the scope and spirit of the invention as described and defined in the following claims.

I claim:

1. A gun sight system defining an aiming point comprising:

a front sight having an elongated base member mounted to a gun barrel spaced from a muzzle end of said gun barrel, said base member detachably securing an elongated first light-gathering means having a triangularly shaped rearward viewing end; and a rear sight having a housing defining an encircled void therethrough, said void providing an unobstructed view of the front sight, a retainer member and a second light-gathering means, said housing mounted to said gun barrel spaced rearwardly from said front sight, whereby said second light-gathering means is removably mated with the retainer member, said retainer member and mated second light-gathering means secured within a recess of said housing whereby two rearward facing triangularly shaped ends of the second light-gathering means extend into the housing void such that an intersection of an imaginary horizontal line joining the triangularly shaped rearward ends of the second light-gathering means and an apex of the triangularly shaped first end of the first light-gathering means define the aiming point.

2. The gun sight of claim 1 wherein the first and second light-gathering means comprise a length of solid cylindrical colored plastic which is light-transparent.

3. The gun sight system of claim 1 wherein the base member slopes upward in the direction of a muzzle end of the gun.

4. The gun sight system of claim 1 wherein the base member includes one or more spaced stirrups extending upwardly defining a passageway to detachably secure said first-light gathering means.

5. The gun sight system of claim 1 wherein the gun includes a ventilated ribbed barrel, said front sight and rear sight being mounted to an upper surface of said ventilated rib.

6. The gun sight system of claim 1 wherein the first and second light-gathering means are at least partially exposed to light.

7. The gun sight system of claim 1 wherein the second light-gathering means is semi oval-shaped.

8. The gun sight system of claim 1 wherein the triangularly-shaped rearward viewing end of the front sight and the two rearward facing triangularly shaped ends of the rear sight define said aiming point.

9. The gun sight system of claim 1 wherein the retainer member includes means to adjust the second light-gathering means in a horizontal plane within the void of the housing.

10. The gun sight system of claim 9 wherein the adjustment means comprises a planar rectangular surface extending from an upper surface of said retainer member, said planar rectangular surface accommodated by a larger rectangular notch in an upper surface of the housing whereby the planar rectangular surface may be laterally adjusted within the notch.

11. A gun sight system comprising:

a front sight mounted to a gun barrel;

a rear sight mounted to a gun barrel, said rear sight defining an encircled void, said void providing an unobstructed view of the front sight;

said front sight including a first light-gathering means having a first end and a second end, said first end triangularly shaped and directed rearward;

said rear sight including a second semi-oval shaped light-gathering means having a first end and a second end, said first and second ends triangularly shaped and directed rearward; and an intersection of an imaginary horizontal line ioining the triangularly shaped rearward ends of the second light-gathering means and an apex of the triangularly shaped first end of the first light-gathering means defining an aiming point.

12. The gun sight of claim 11 wherein the first and second light-gathering means comprises a length of solid cylindrical colored plastic which is light-transparent.

13. The gun sight system of claim 11 wherein the front sight further includes a base member sloping upward in the direction of a muzzle end of the gun.

14. The gun sight system of claim 13 wherein the base member includes one or more spaced stirrups extending upwardly defining a passageway to detachably secure said first-light gathering means.

15. The gun sight system of claim 11 wherein the gun includes a ventilated ribbed barrel, said front sight and rear sight being mounted to an upper surface of said ventilated rib.

16. The gun sight system of claim 11 wherein the first and second light-gathering means are at least partially exposed to light.

17. The gun sight system of claim 11 wherein the second light-gathering means is semi oval-shaped.

* * * * *